US006311602B1

(12) United States Patent
Gerber et al.

(10) Patent No.: US 6,311,602 B1
(45) Date of Patent: Nov. 6, 2001

(54) DEVICE FOR COOLING GUN BARRELS OF FIREARMS

(75) Inventors: Michael Gerber; Gabriel Schneider, both of Zurich (CH)

(73) Assignee: Oerlikon Contraves AG, Zurich (CH)

( * ) Notice: Subject to any disclaimer, the term of this patent is extended or adjusted under 35 U.S.C. 154(b) by 0 days.

(21) Appl. No.: 09/352,469

(22) Filed: Jul. 14, 1999

(30) Foreign Application Priority Data

Jul. 14, 1998 (CH) ..... 1504/98

(51) Int. Cl.[7] ..... F41A 13/04
(52) U.S. Cl. ..... 89/1.25; 89/14.1
(58) Field of Search ..... 89/1.25, 14.1

(56) References Cited

U.S. PATENT DOCUMENTS

| | | | | |
|---|---|---|---|---|
| 2,774,281 | * | 12/1956 | Hawkins | 89/14.1 |
| 4,062,266 | * | 12/1977 | Elmore et al. | 89/14.1 |
| 4,535,676 | * | 8/1985 | Politzer et al. | 89/14.1 |
| 4,884,490 | * | 12/1989 | Hurlemann | 89/14.1 |
| 5,841,057 | * | 11/1998 | Birk | 89/1.25 |

FOREIGN PATENT DOCUMENTS

| | | | | |
|---|---|---|---|---|
| 31 45 764 A1 | | 6/1983 | (DE) . | |
| 0 313 856 A1 | | 5/1989 | (EP) . | |
| 1 112 677 | | 3/1956 | (FR) . | |
| 2222237 | * | 2/1990 | (GB) | F41D/11/20 |

* cited by examiner

*Primary Examiner*—Michael J. Carone
*Assistant Examiner*—John Richardson
(74) *Attorney, Agent, or Firm*—Townsend and Townsend and Crew; Guy W. Chambers

(57) ABSTRACT

The service life of gun barrels of firearms with a high cyclic rate can be extended by means of the cooling device of the invention. To this end, coolant (7) is conveyed from a reservoir (6) into a pressure cylinder (10) by drawing up a hydraulic cylinder (13), while the feed line (14) to the gun barrel is closed. Thereafter the hydraulic piston (13) is moved in the opposite direction by a pressure reversal and the coolant (7) in the pressure cylinder (10) is placed under a defined operating pressure. Prior to triggering a volley, the feed line (14) is opened, so that the coolant (7) can flow via the feed line (14) and the nozzle (16) to the gun barrel (1). The coolant (7) is pushed back by the gas pressure respectively being created when a shot is fired, and following the lowering of the gas pressure to the operating pressure, it is again injected into the gun barrel (1).

5 Claims, 1 Drawing Sheet

DEVICE FOR COOLING GUN BARRELS OF FIREARMS

FIELD OF THE INVENTION

The invention relates to a method for cooling gun barrels of firearms, wherein a coolant is provided to the gun barrel via at least one feed line and at least one nozzle. The invention further relates to a device for executing the method.

BACKGROUND OF THE INVENTION

A cooling device for the gun barrels of firearms in accordance with the preamble is known from German Letters Patent DE-PS 31 45 764, which is particularly suited for automatic firearms and heavy-duty automatic cannons. In connection with such heavy-duty firearms firing highly developed munitions, the great wear of the gun barrels is a result of the fact that the surface heat cannot be dissipated with sufficient speed. The heat stress, which occurs in rapid sequence when firing a volley, causes surface tensions and changes in the material. In addition, because of the outflowing powder gases, as well as the friction between the shell and the gun barrel, the material of the gun barrel is worn off.

To extend the service life of the gun barrels, the above mentioned patent proposes to provide cooling conduits in the area of the end section of the gun barrel adjoining a drum, which are oriented radially outward between the individual cartridge seats and which are connected with a main conduit for coolant supply extending in the drum axis. The cooling conduits are connected with nozzles which extend parallel in respect to the longitudinal direction of the drum, terminate in the front face of the drum and are arranged at the same distance from the longitudinal axis of the drum as the center longitudinal axis of the cartridge seats. Blocking elements for the nozzles are provided in the cooling conduits which, in the case of firing, briefly release the respective nozzle located in the area of the barrel opening. The blocking elements are, for example, slides, which can be displaced by means of control elements sliding along a control cam during the rotating movement of the drum. The coolant reaches the interior wall of the gun barrel directly through the nozzles. In this case the nozzles are only opened for the period of time they slide by the rear of the gun barrel, and coolant is only provided if firing takes place. However, the length of sliding time can be too short in connection with gun barrel systems of higher cyclic rates, or respectively with more intense rhythmic firing, so that not enough coolant reaches the gun barrel and insufficient cooling is possibly provided.

OBJECT AND SUMMARY OF THE INVENTION

The object of the invention is based on proposing a method and a device of the type mentioned at the outset, by means of which sufficient cooling of the gun barrels of weapons systems with high cyclic rates can be achieved.

This object is attained by means of the invention recited. Here, coolant is conveyed from a reservoir into a pressure cylinder by drawing up a hydraulic piston, in the course of which the feed line to the gun barrel is closed. Thereafter, the hydraulic piston is moved in the opposite direction by reversal of the pressure, and the coolant in the pressure cylinder is put under a defined operating pressure. Prior to triggering a volley, the feed line is opened so that the coolant can flow via the feed line and the nozzle to the gun barrel. The coolant is respectively pushed back by the gas pressure created when a shot is fired, and is injected into the gun barrel after the gas pressure has been reduced to the operating pressure.

The advantages which can be achieved by means of the invention reside in particular in the automatic re-lubrication of the gun barrel and the increased service life of the barrel in connection with higher firing cycles. By using one or several nozzles it is assured that a sufficiently large amount of coolant is injected into the gun barrel, wherein only little coolant can flow back after each round.

A further advantage can be seen to reside in that during the employment of the proposed cooling device no mechanically actuated parts are required, with the exception of the piston, so that a high degree of dependability can be achieved.

The invention will be explained in what follows by means of an exemplary embodiment in connection with the drawings.

DETAILED DESCRIPTION OF THE PREFERRED EMBODIMENT

Figure 1:
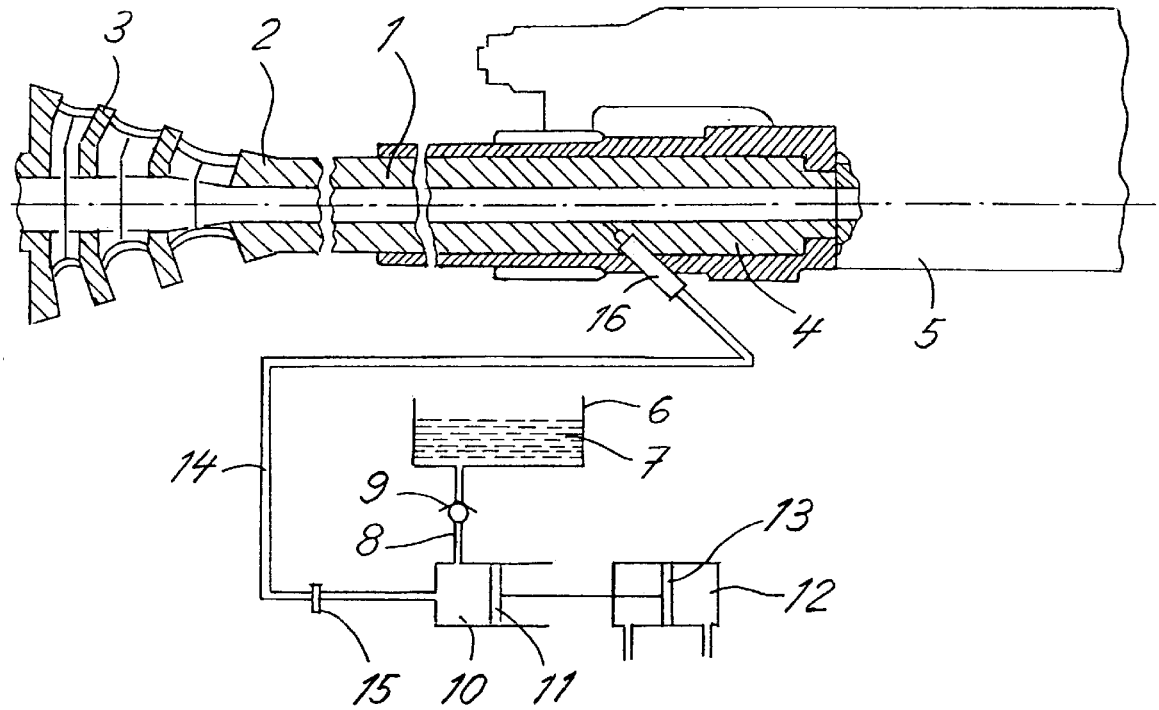
FIG. 1 shows a partial longitudinal section of a cannon with the device in accordance with the invention in a schematic representation.
Figure 2:
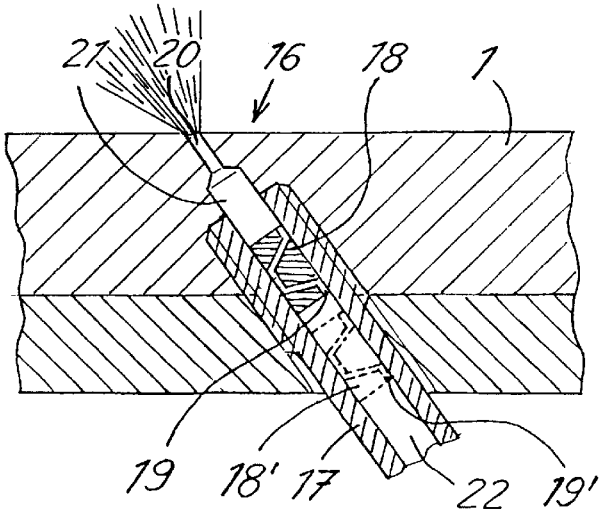
FIG. 2 shows a nozzle of the device in FIG. 1 in an enlarged scale.

A gun barrel of an automatic cannon is identified by 1 in FIGS. 1 and 2, which has a muzzle brake 3 at its front 2 and on whose back end 4 a revolving housing 5 with a revolving drum, not shown in greater detail, is arranged. A reservoir 6, which contains a coolant 7 being used as a lubricant for the gun barrel 1 at the same time, is connected via a line 8 and a flap valve 9 with a pressure cylinder 10. A piston 11, which is fixedly connected with a hydraulic piston 13 guided in a hydraulic cylinder 12, is guided in the pressure cylinder 10. The pressure cylinder 10 is connected via a feed line 14 and a valve 15 which, for example, can be electrically controlled, with a gun barrel 1. A nozzle 16, which has a sleeve 17 connected with the feed line 14 and is fixed in place on the gun barrel 1, is provided at the termination of the feed line 14 located at the back end 4 of the gun barrel 1. In the embodiment of FIGS. 1 and 2, the nozzle 16 is arranged obliquely toward the axis of the gun barrel; however, good results have been obtained by arranging a pair of nozzles in a plane perpendicular to the axis of the gun barrel and spraying the coolant toward each other and into the central section of the gun barrel. The result is a whirl of the two currents of coolant emerging from the two nozzles and a very effective mist of coolant drops in the air and gas contained in the gun barrel. It is, of course, also possible, but less effective, for a whirl to arrange the nozzles symmetrically, but not perpendicular to the axis of the gun barrel, so that the ejected coolant streams meet somewhere in the central section of the gun barrel.

A labyrinth 18 or 18' in the form of one or several insertion pieces is arranged in the sleeve 17, in which a labyrinth or meander like conduit 19, or respectively 19', for example is provided which, as will be explained later, causes a pressure reduction. Alternatively, instead of labyrinth insertion pieces, a similar effect can be obtained by arranging a diaphragm in the path of the coolant. A nozzle bore in the gun barrel 1 is identified by 20 which, in the present case, is arranged concentrically in respect to the sleeves 17 and whose diameter is less than that of the feed bores 21, 22 provided in the gun barrel 1, or respectively in the sleeve 17.

The above described device functions as follows:

By drawing up the hydraulic piston 13, the coolant 7 is conveyed from the reservoir 6 via the line 8 and the flap valve 9 into the pressure cylinder 10, while the electrically actuable valve 15 in the feed line 14 is closed. Thereafter, the hydraulic piston 13, and with it also the piston 11, is moved in the opposite direction by a pressure reversal in the hydraulic cylinder 12, and the coolant 7 in the pressure cylinder 10 is placed under a defined operating pressure of, for example, approximately 500 bar, so that the device is ready for use. Prior to triggering a volley, the valve 15 is opened, so that the coolant 7 can flow to the gun barrel 1 via the feed line 14 and the nozzle(s) 16. The high gas pressure of, for example, approximately 5000 bar being created in the course of subsequent firing pushes the coolant back, wherein the gas pressure is reduced by friction in the nozzle 16 to the operating pressure of approximately 500 bar and only little coolant flows back. As soon as the gas pressure in the gun barrel 1 has been reduced, the coolant 7 is continuously injected into the gun barrel 1 by the operating pressure until a further shot is fired. The valve 15 is closed again at the end of a series.

What is claimed is:

1. A method for cooling a gun barrel comprising the steps of:

conveying a coolant from a coolant reservoir into a pressure cylinder by drawing up a hydraulic piston connected to said cylinder while a coolant feed line from said cylinder to the gun barrel is closed, thereafter moving the hydraulic piston in the opposite direction by a pressure reversal, wherein the coolant in the pressure cylinder is placed under a predefined operating pressure which is higher than the ambient pressure, opening said coolant feed line prior to firing an ammunition round in said gun barrel so that the coolant flows to the gun barrel via the feed line and a nozzle, firing an ammunition round which thereby pushes said coolant back toward said pressure cylinder as a result of gases released by said fired ammunition round exerting a pressure above said predefined operating pressure, and injecting coolant back into the gun barrel again after the gas pressure has been reduced to below said predefined operating pressure.

2. The method in accordance with claim 1, wherein the predetermined operating pressure lies between the ambient pressure and the gas pressure during firing.

3. A device for cooling a gun barrel comprising:

at least one nozzle adapted to inject coolant into said gun barrel which is connected with a feed line for said coolant, a pressure cylinder connected to the other end of said coolant feed line via a one way valve, said pressure cylinder is connected via a further line and further one way valve with a coolant reservoir, and also connected to a piston guided in the pressure cylinder by a hydraulic cylinder, wherein said hydraulic cylinder piston acts with said pressure cylinder to draw coolant from said reservoir and inject it into said feed line.

4. The device in accordance with claim 3, wherein the nozzle has a sleeve, in which at least one labyrinth in the form of one or more insertion pieces is arranged so that said coolant takes a meandering path to said nozzle.

5. The device in accordance with claim 3, wherein said one way valves are flap valves.

* * * * *